US007429032B2

(12) United States Patent
Stull

(10) Patent No.: US 7,429,032 B2
(45) Date of Patent: Sep. 30, 2008

(54) BALANCED GATE MECHANISM

(75) Inventor: Edward J. Stull, Oxford, MI (US)

(73) Assignee: Turnstyle Intellectual Property, LLC, Georgetown, SC (US)

( * ) Notice: Subject to any disclaimer, the term of this patent is extended or adjusted under 35 U.S.C. 154(b) by 199 days.

(21) Appl. No.: 11/036,667

(22) Filed: Jan. 14, 2005

(65) Prior Publication Data

US 2005/0156149 A1 Jul. 21, 2005

Related U.S. Application Data

(60) Provisional application No. 60/536,926, filed on Jan. 16, 2004.

(51) Int. Cl.
*E06B 11/02* (2006.01)

(52) U.S. Cl. ..... 256/73; 49/381

(58) Field of Classification Search ..... 256/73, 256/DIG. 5; 49/381, 385, 386, 365, 326, 49/333, 49, 236–239; 16/275, 280, 285, 16/295

See application file for complete search history.

(56) References Cited

U.S. PATENT DOCUMENTS

| | | | | |
|---|---|---|---|---|
| 28,205 | A | 5/1860 | Sill | |
| 163,084 | A | 5/1875 | Krom | |
| 203,575 | A | 5/1878 | Arnn | |
| 326,548 | A | 9/1885 | Crowfoot | |
| 363,964 | A | 5/1887 | Philpott | |
| 447,819 | A * | 3/1891 | Gorham | 49/237 |
| 571,237 | A | 11/1896 | Philpott | |
| 780,623 | A * | 1/1905 | Sisk | 49/239 |
| 920,305 | A | 5/1909 | Finch | |
| 933,677 | A | 9/1909 | Smith | |
| 1,221,796 | A * | 4/1917 | Egbert | 312/249.2 |
| 1,383,961 | A * | 7/1921 | Melugin | 16/314 |
| 1,462,766 | A | 7/1923 | Post | |
| 1,540,490 | A * | 6/1925 | Mertel | 49/381 |
| 1,594,260 | A | 7/1926 | Herr | |
| 1,630,200 | A | 5/1927 | Merrill | |
| 1,891,739 | A * | 12/1932 | Wenger | 246/126 |
| 2,151,052 | A * | 3/1939 | Smart et al. | 49/239 |
| 3,626,547 | A * | 12/1971 | Werner | 16/314 |
| 5,133,152 | A * | 7/1992 | Grancagnolo | 49/239 |
| 5,277,488 | A * | 1/1994 | Cleary et al. | 312/408 |
| 5,373,664 | A * | 12/1994 | Butler | 49/358 |

FOREIGN PATENT DOCUMENTS

| | | |
|---|---|---|
| DE | 20121216 | 6/2002 |
| EP | 0 152 210 | 8/1985 |
| EP | 0 743 464 | 11/1996 |
| GB | 585176 | 1/1947 |
| WO | 2005/073494 | 8/2005 |

OTHER PUBLICATIONS

International Search Rerport dated May 24, 2005.

* cited by examiner

*Primary Examiner*—Daniel P. Stodola
*Assistant Examiner*—Joshua T Kennedy
(74) *Attorney, Agent, or Firm*—Carlson, Gaskey & Olds

(57) ABSTRACT

A balanced gate assembly utilizing plastic or vinyl fencing materials includes a rotatable center post that balances loads. An inner post assembly includes a bearing along a central axis for supporting the load of the gate. The balanced gate assembly carries loads along the center post to provide for the utilization of light weight materials such as plastic and vinyl.

7 Claims, 6 Drawing Sheets

BALANCED GATE MECHANISM

REFERENCE TO RELATED APPLICATIONS

This application claims priority to U.S. Provisional Application Ser. No. 60/536,926 filed Jan. 16, 2004.

BACKGROUND OF THE INVENTION

This invention relates generally to a gate assembly, and specifically to a balanced gate assembly rotatable about a support member.

Fences typically include a series of posts that are fixed within the ground with horizontal members extending between those posts. Gates are typically mounted to a fence post and extend across an opening between fence posts. Typically, the entire weight of the gate is supported by a single fence post. Depending on the size and length of the gate, an imbalanced force is exerted on the fence post supporting the gate causing the post to tilt away from a desired position, causing misalignment of the gate.

Plastic and vinyl fencing have become popular alternatives to traditional wood and steel fencing. Plastic and vinyl fencing is often less costly, and easier to install. Further, plastic and vinyl fencing require less maintenance. Plastic and vinyl fencing includes prefabricated post and rail components that are easily assembled. However, plastic and vinyl fence posts are not designed to support great amounts of weight such as is required to support a traditional gate. Consumers are therefore forced to go without a gate or revert to the use of traditional materials such as steel and wood to accommodate the increased load of a gate. However, combining traditional materials with the plastic fence provides an undesirable appearance, and may be beyond the skill of the typical consumer. Further, the use of traditional materials is contrary to the benefits provided by the plastic and vinyl gate.

Accordingly, it is desirable to design an improved gate assembly that eliminates imbalanced loads and is compatible with plastic and vinyl fencing materials.

SUMMARY OF THE INVENTION

This invention is a balanced gate assembly that includes a rotatable center that balances loads.

The gate assembly of this invention includes the center post mounted within the ground and disposed an equal distance from each end of the gate. The center post includes an inner post assembly that supports the weight of the gate. Supporting the gate at a center point balances the gate such that no imbalanced forces are present. The weight of one side of the gate is balanced against weight on another side of the gate.

The inner post assembly includes an inner support post and an outer tube assembly. The outer tube assembly is mounted to be rotatable about the inner support post. The gate structure is mounted to rotate with the outer tube assembly. Because the weight of the gate is balanced about the center post, lighter materials such as plastic and vinyl can be used. Further, fence posts on either side of the gate are not required to carry the imbalanced forces cause by typical gate assemblies, and therefore can also be fabricated from lighter materials such as plastic and vinyl.

The gate assembly includes a biasing member that biases the gate toward a closed position. Further, the gate assembly includes a lock assembly to prevent rotation of the gate unless actuated. The lock assembly is disposed within the center post assembly and therefore does not require latches or other structures to be mounted to either of the fence posts.

Accordingly, the gate assembly of this invention provides an improved gate assembly that eliminates imbalanced loads and is compatible with plastic and vinyl fencing materials.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
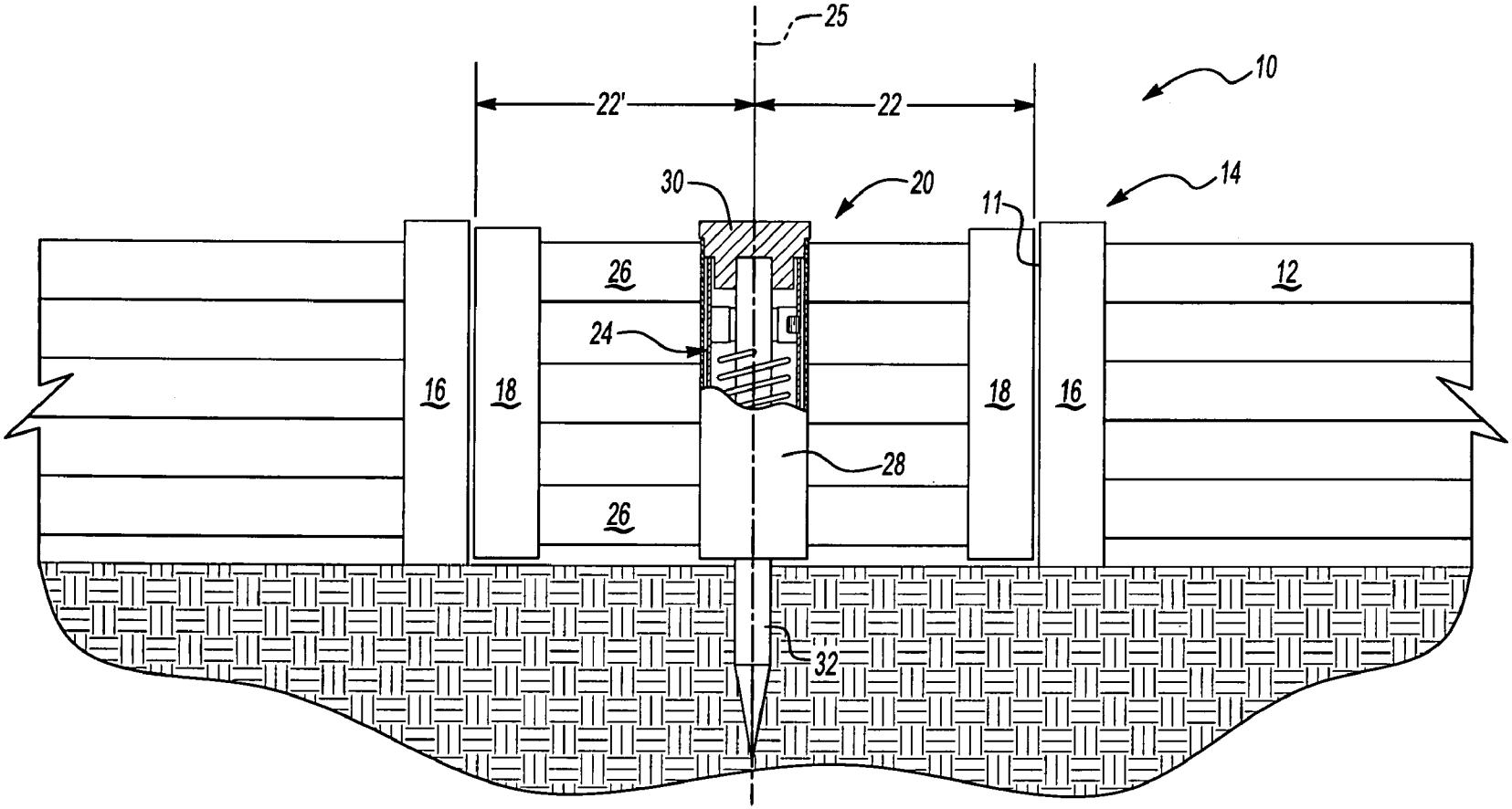
FIG. 1 is a plan view of the gate assembly according to this invention.

Referring to FIG. 1, a gate assembly 10 for a fence structure 12 is disposed within an opening 11. The opening 11 is formed between two vertical posts 16. The gate assembly 10 includes a center post 20. The center post 20 is disposed between outboard posts 18. The outboard posts 18 are connected to the center post 20 by way of rails 26. The center post 20 includes a support rod 32 that is fixed within the ground.

The center post 20 is disposed an equal distance between each of the outboard posts 18. A distance 22, 22' between the center post 20 and the outboard posts 18 is equal. The equal distance between the center post 20 and each of the outboard posts 18 results in the weight of the gate being supported by the center post 20 along a central vertical axis 25. Further, although an equal distance is shown, all that is required is a balance of loads on opposite sides of the center post 20. Accordingly, the distances 22, 22' may be unequal, with a greater weight on the shorter side to provide a balanced load.

The center post 20 includes an outer post structure 28 to which the rails 26 are attached and the inner post assembly 24. The inner post assembly 24 is attached to a cap 30. The cap 30 is in turn attached to the outer post structure 28.

Figure 2:
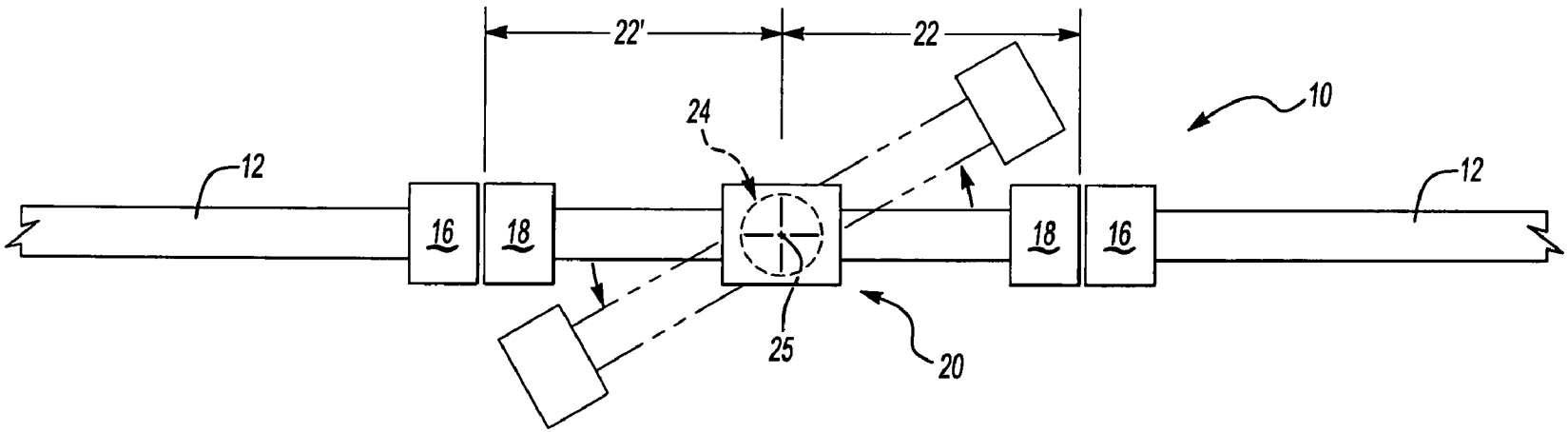
FIG. 2 is a top view of the gate assembly according to this invention.

Referring to FIG. 2, a top view of the gate assembly 10 of this invention is shown. The gate assembly 10 rotates about the center post 20. The distance between each of the outboard posts 18 and the center post assembly 20 are equal. Equal distances 22, 22' balance the weight of the gate such that the gate assembly 10 does not required additional structural components to accommodate load imbalances. This configuration provides for constriction of the gate assembly 10 from lightweight material such as the vinyl and plastic.

Figure 3:
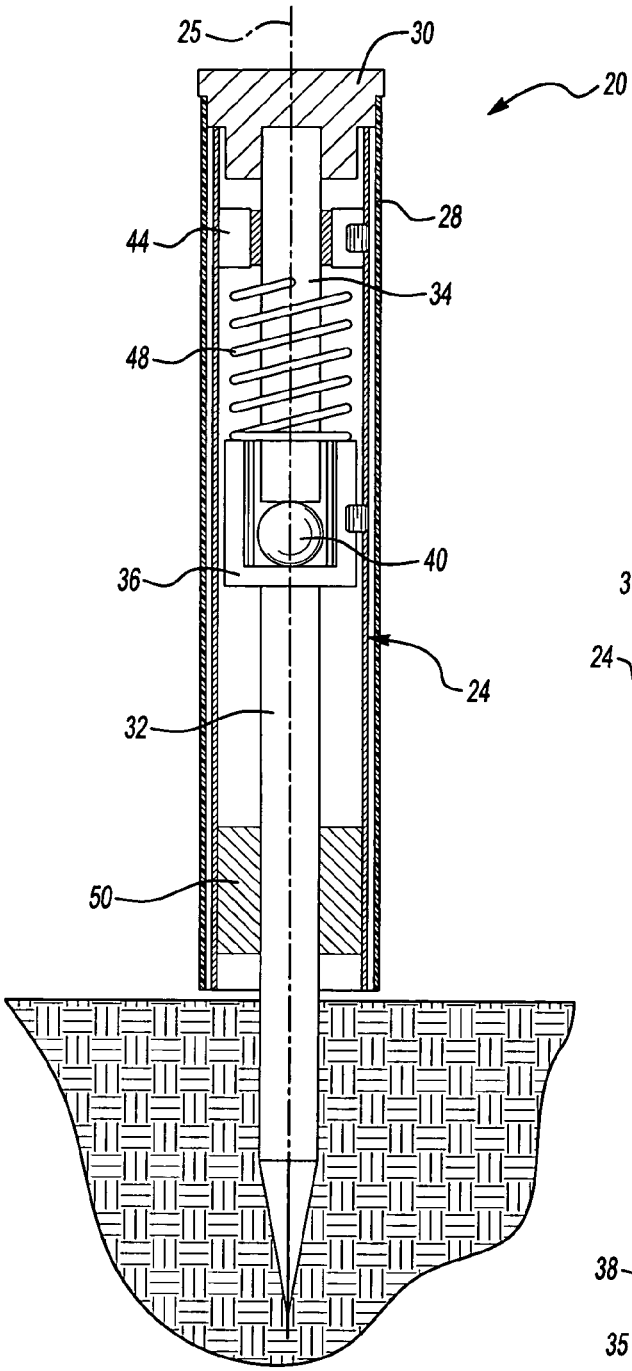
FIG. 3 is a cross-sectional view of the center post assembly.

Referring to FIG. 3, the inner post assembly 24 of the center post 20 is shown with the plastic outer post structure 28 removed. The outer post structure is preferably fabricated from plastic or vinyl and is adapted to fit and attach to the inner post assembly 24.

The inner post assembly 24 includes the cap 30 that is mounted to a rotatable support rod 34. The rotatable support rod 34 is supported within a bearing cup 36. Within the bearing cup 36 is a ball bearing 40. The weight of the post 20 is distributed along the vertical axis 25 through the cap 30 onto the rotatable support rod 34 and onto the ball bearing 40 within the bearing cup 36. The bearing cup 36 is fixed to the fixed support rod 32. The rotatable support rod 34 is therefore rotatably supported by the ball bearing 40 relative to the fixed support rod 32.

The rotatable support rod 34 is supported on a first end within the first bearing cup 36 and on a second end within a second bearing 44. The bearing cup 36 and bearing 44 maintain alignment of the rotatable support rod 34 relative to the vertical axis 25 centered on the support 32 and the rotatable support rod 34. The outer fence structure 28 attached to the cap 30 for rotation relative to the fixed support rod 32. A support bearing 50 is disposed between the fixed support rod 32 and the outer post 28 for maintaining alignment of the outer fence structure 28 relative to the vertical axis 25. The bearing 50 provides for rotation and prevents wobbling between the fixed support rod 32 and the outer post structure 28.

Figure 4:
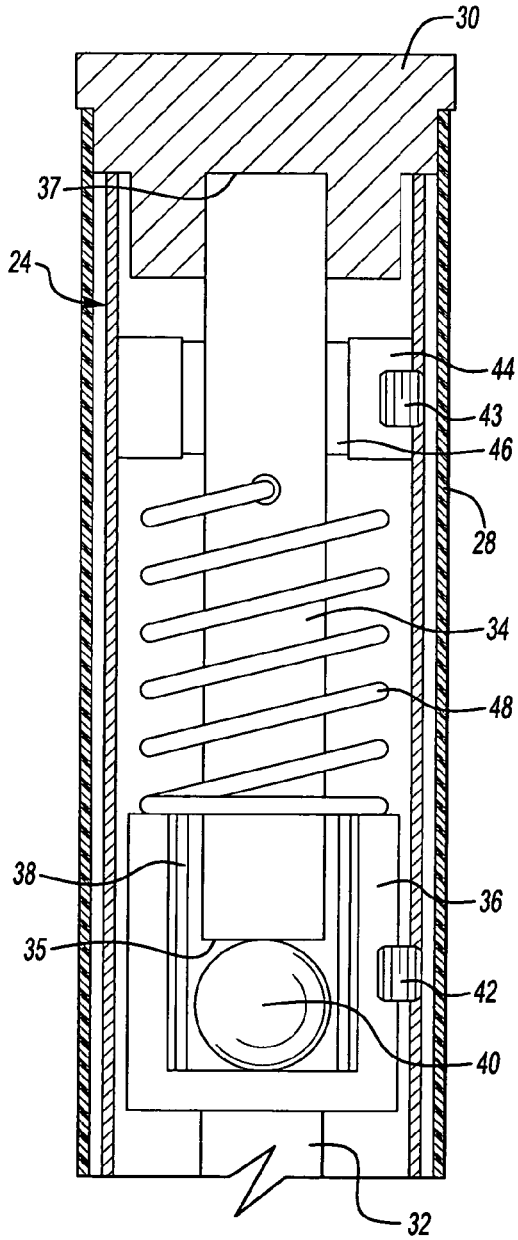
FIG. 4 is an enlarged cross-sectional view of the center post assembly of this invention.

Referring to FIG. 4, the inner post assembly 24 is shown in an enlarged view and includes the ball bearing 40 disposed within the bearing cup 36. Also within the bearing cup 36 is a bearing sleeve 38. The bearing sleeve 38 is consists of a material having a low coefficient of friction for guiding the support rod 34. A first end 35 of the support rod 34 rests on the ball bearing 40 within the bearing cup 36. A second end 37 of the support rod is fixed to the cap 30, which is in turn attached to the plastic, or vinyl outer fence structure 28. The load and weight of the gate is supported through the rotatable support rod 34 and ball bearing 40 mounted to the fixed support along the axis 25.

Fixed support rod 32 extends upward past the bearing cup 36 upwards toward a point adjacent the cap 30. The fixed support rod 32 however is not attached to the cap 30 such that the cap 30 is free to rotate relative to the fixed support rod 32. The rotatable support rod 34 is supported on an end opposite the bearing cup 36 by the bearing 44. The bearing 44 includes another bearing collar 46. The bearing collar 46 is provided and comprised of a material that reduces friction relative to the material that is utilized to fabricate the rotatable support rod 34.

The bearing cup 36 and bearing 44 are attached to the fixed support rod 32 by way of threaded fasteners 42, 43. Preferably, the threaded fasteners 42, 43 are Allen type set screws. However, it is within the contemplation of this invention that other fasteners may be used.

A return spring 48 is disposed around the rotatable support rod 34. The return spring 48 is fixed to a portion of the bearing cup 36 on a first end 35 and to the rotatable support rod 34 on a second end 37. The intermediate or midpoints of this spring 48 wrapped around the rotatable support rod 34. Accordingly, the return spring 48 returns the gate assembly to a desired position upon release. Although a coil spring is illustrated other springs as are known are within the contemplation of this invention.

Figure 5:
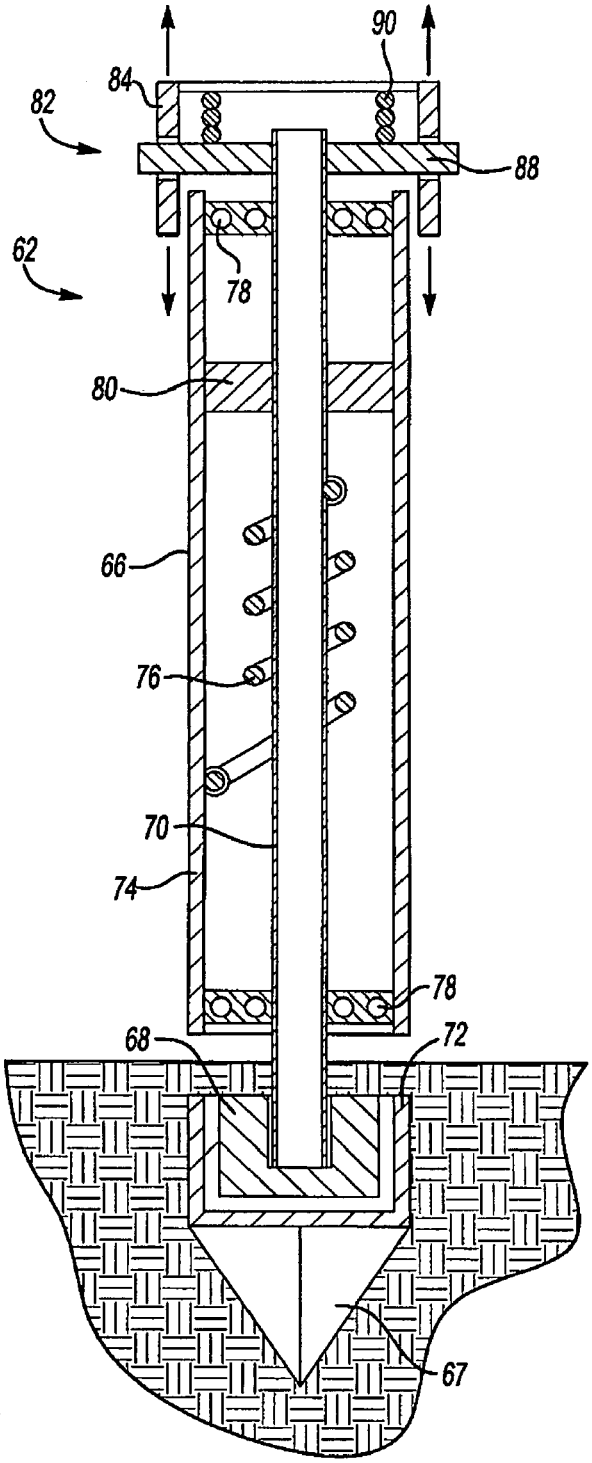
FIG. 5 is a cross-sectional view of another example center post assembly according to this invention.

Referring to FIG. 5, another example balanced gate mechanism according to this invention includes a center post generally indicated at 62 having an inner post assembly 66 mounted within a mount block 68. The inner post assembly 66 includes a support tube 70 that is mounted within the mount block 68. The mount block 68 is mounted within the ground below the grade of the fence 12.

The support tube 70 is fixed and does not rotate relative to the mount block 68. The mount block 68 can be mounted within the ground below grade by a mount assembly 72. The post mount assembly 72 shown includes a cavity within which the mount block 68 is supported. The cavity is defined adjacent to a spade portion that is driven into the ground. The post mount assembly 72 shown provides for the easy removal of the entire gate assembly 10.

Figure 6:
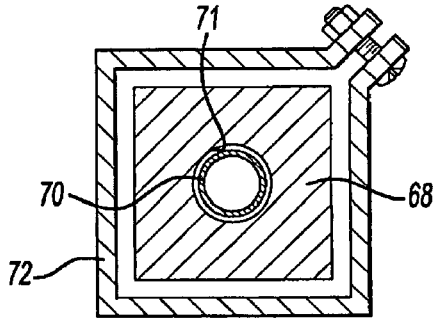
FIG. 6 is a top view of a mount block having an adaptor for supporting the support tube.

Referring to FIG. 6, the mount block 68 is shown within the post mount assembly 72. The mount block 68 functions as an adaptor for supported the support tube 70. The support tube 70 is received within an opening 71 within the mount block 68. The post mount assembly 72 simplifies assembly and installation of the gate assembly 10 by eliminating digging or excavating as can be required in conventional gate post installation. As appreciated, this simplification comports favorably with the utilization of light weight materials such as plastic and vinyl.

Figure 7:
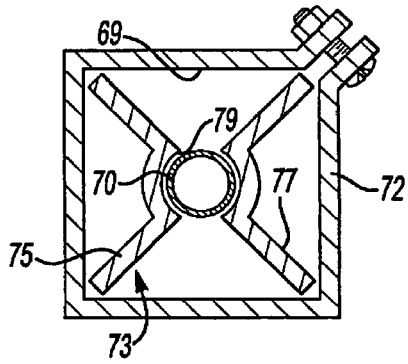
FIG. 7 is a top view of another example adaptor according to this invention.
Figure 8:
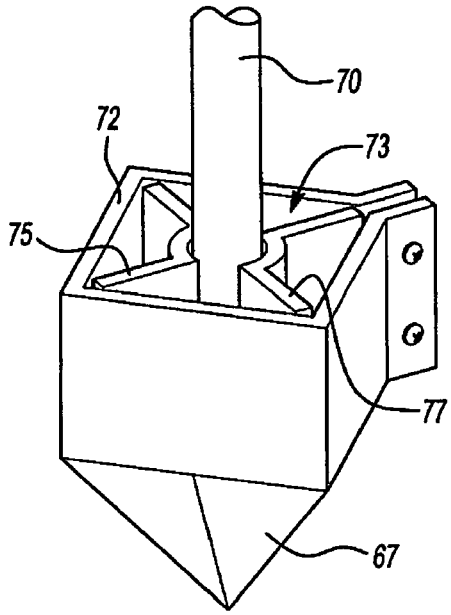
FIG. 8 is a perspective view of the adapter illustrated in FIG. 7.

Referring to FIGS. 7 and 8, an adapter 73 is shown including first and second parts 75, 77 that are mounted within a cavity of the post mount assembly 72 for supporting the support tube 70. The first and second parts 75,77 define a central opening 79 for the support tube 70. From the central opening 79 each of the first and second parts include arms that engage an inner surface 69 of the post mount assembly 72. The adapter 73 provides for the easy removal and installation of the gate assembly. The post mount assembly 72 is inserted into the ground utilizing a spade portion 67. The post mount assembly 72 remains in the ground but allows removal of the gate as desired. Accordingly, the gate may be removed for allowing access to larger items such as vehicles through the fence, and reinstalled easily by reinserting the support tube 70 into the central opening 79.

Further, the post mount assembly 72 maybe adjustable to provide for vertical or horizontal alignment of the gate assembly. Installation of the post mount assembly 72 can vary depending on the application conditions. Accordingly, an adjustable post mount assembly provides for easy adjustment and alignment of the gate assembly to provide for ease of rotation provided by a desired vertical alignment relative to the axis 25.

Figure 9:
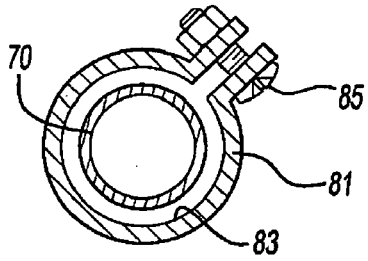
FIG. 9 is a top view of an example circular post mount assembly according to this invention.
Figure 10:
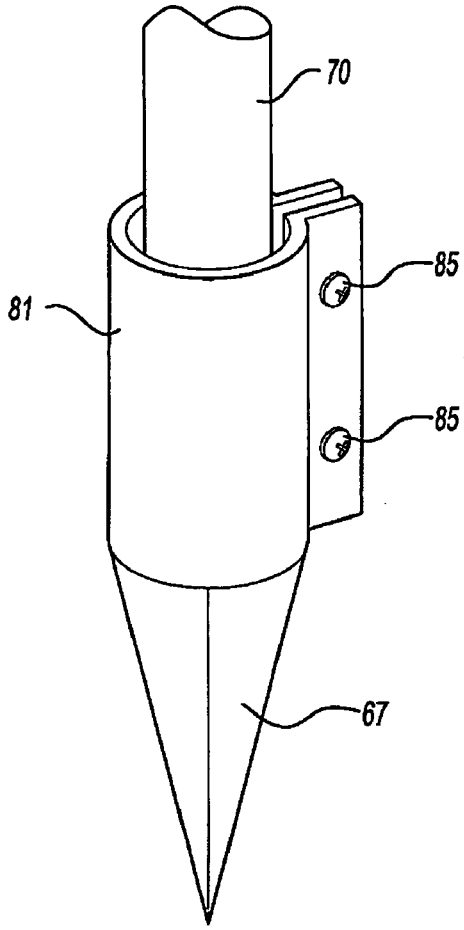
FIG. 10 is a perspective view of the circular post mount assembly.

Referring to FIGS. 9 and 10, another post mount assembly 81 is shown that includes a cylindrical cavity 83 for receiving the support tube 70. The cylindrical cavity 83 further simplifies installation by eliminating the requirement of an adapter or mount block. The support tube 70 is inserted within the post mount assembly 81 and is secured by tightening threaded fasteners 85 disposed adjacent a split portion 87. As appreciated, other known mounting assemblies are within the contemplation of this invention.

Referring back to FIG. 5, the inner post assembly 66 includes the support tube 70 and an outer tube 74. The outer tube 74 rotates about the support tube 70 to allow rotational movement of the gate assembly 10. A biasing member 76 is disposed between the support tube 70 and the outer tube 74 to bias the outer tube 74 and thereby the gate assembly 10 toward a closed position.

The support tube 70 is fixed and does not rotate. The outer tube 74 rotates about the support tube 70 and is attached to the support tube 70 by bearings 78. The bearings 78 are shown adjacent each end of the outer tube 74. As appreciated, other bearings or other support members that would provide for the rotation of the outer tube 74 relative to the support tube 70 are within the contemplation of this invention.

The biasing member 76 is disposed between the outer tube 74 and the support tube 70. Preferably, the biasing member 76 is a torsion spring that is attached at one end to the fixed support tube 70 and at a second end to the rotatable outer tube 74. Rotation of the outer tube 74 relative to the support tube 70 is therefore biased in a desired direction. The bias of the outer tube 74 relative to the support tube 70 is biased such that the gate assembly 10 will return to a closed position. Further, a damping member 80 is provided to control closing movement of the gate assembly 10. The damping member 80 may be of any kind known to a worker skilled in the art.

As is appreciated, the gate assembly 10 of this invention allows ingress and egress from either side of the gate assembly by rotating the gate assembly 10 about the center post assembly 62. The gate assembly 10 includes a locking assembly 82 to prevent unwanted opening of the gate assembly 10. The lock assembly 82 is disposed on the center post assembly 62. This eliminates the need for a lock or latch assembly mounted on the posts 16 of the fence 12.

The lock assembly 82 includes a collar 84 moveable vertically relative to pins 88 that extend from the fixed support tube 70. The pins 88 are exposed within a slot (FIG. 5) in the collar 84. The collar 84 is biased towards a locked position by a biasing spring 90.

Figure 11:
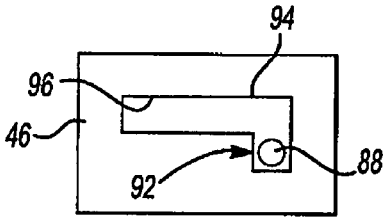
FIG. 11 is a schematic view of a portion of the lock assembly for this invention.

Referring to FIG. 11, the lock position is provided when the pins 88 are biased into a notch portion 92 of the slot 94. Pushing the collar 84 downward allows the pin 88 to move upward within the slot 94 so that it may be rotated within a lengthwise portion 96 of the slot 94. This movement allows rotation of the gate assembly 10. Once the gate assembly 10 is released, the biasing member 76 rotates the gate assembly 10 such that the collar 84 moves relative to the support tube 70 until the pins 88 return to the notch portion 92 of the slot 94. With the pins 88 in the notch portion 92, the gate remains closed and locked. The lock assembly 82 is shown in cross section where the pin 88 is disposed within the slot 108. The collar 84 is moveable upward to free the pin 88 from the slot 88. Although a lock assembly is shown and described, it is within the contemplation of this invention to utilize other lack assembly configurations.

Figure 12:
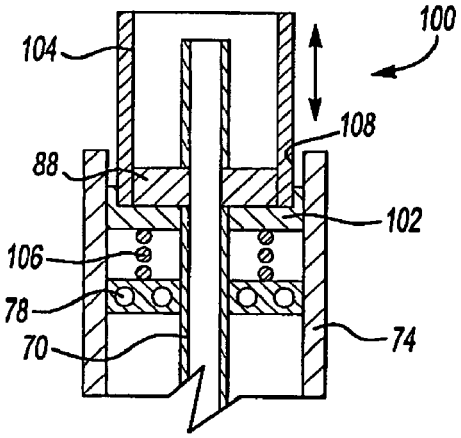
FIG. 12 is a cross-sectional view of another lock assembly for this invention.

Referring to FIG. 12 another lock assembly 100 includes a slotted disc 102. The slotted disc 102 corresponds with fixed pins 88 disposed on the support tube 70. The slotted disc 102 is moveable vertically by way of a button 104. The button 104 and disc 102 are biased into a locked position by a biasing member 106. The biasing member 106 is disposed between a surface of the disc 102 and the bearing 78. The disc 102 includes slots 108 that correspond with the fixed pins 88.

Operation of the lock assembly 100 includes depressing the button 104 such that the pins 88 are free from the slot 108 of the disc 102. Once the pins 88 are free of the slots 108, the outer tube 74 is free to rotate relative to the inner support tube 70. This rotational movement allows the gate assembly 10 to rotate and allow ingress and egress through the fence 12. Once the button 104 is released the pins 88 are still disposed outside of the slot 108. The gate assembly 10 is then biased back toward a closing position. As the gate assembly 10 rotates back to the closed position, the pins 88 move back into the slots 108 to lock the gate assembly 10 into position.

Figure 13:
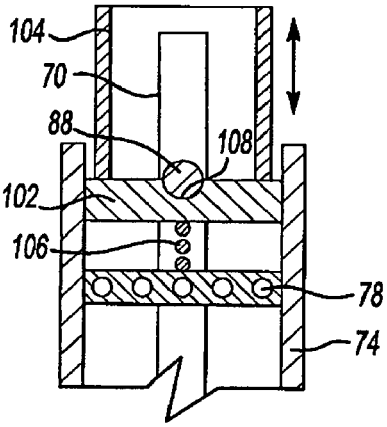
FIG. 13 is a partial cross-sectional view of the lock assembly shown in FIG. 12.

Referring to FIG. 13, the lock assembly 100 is shown in cross section where the pin 88 is disposed within the slot 108. The button 104 is moveable upward to free the pin 88 from the slot 108.

Figure 14:
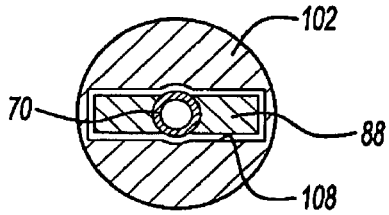
FIG. 14 is a top view of a slotted disc assembly for the lock assembly of FIG. 12.
Figure 15:
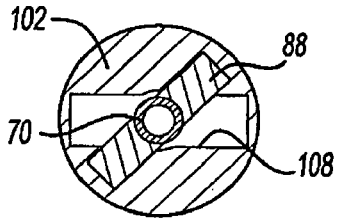
FIG. 15 is another view of the disc assembly as is shown in FIG. 12.

Referring to FIGS. 14 and 15 a top view of the disc 102 is shown with FIG. 8 showing the pins 88 disposed within the slots 108 and FIG. 9 showing the pins 88 outside of the slots 108. It should be appreciated that other configuration of lock assemblies as are known to a worker skilled in the art are within the contemplation of this invention.

Figure 16:
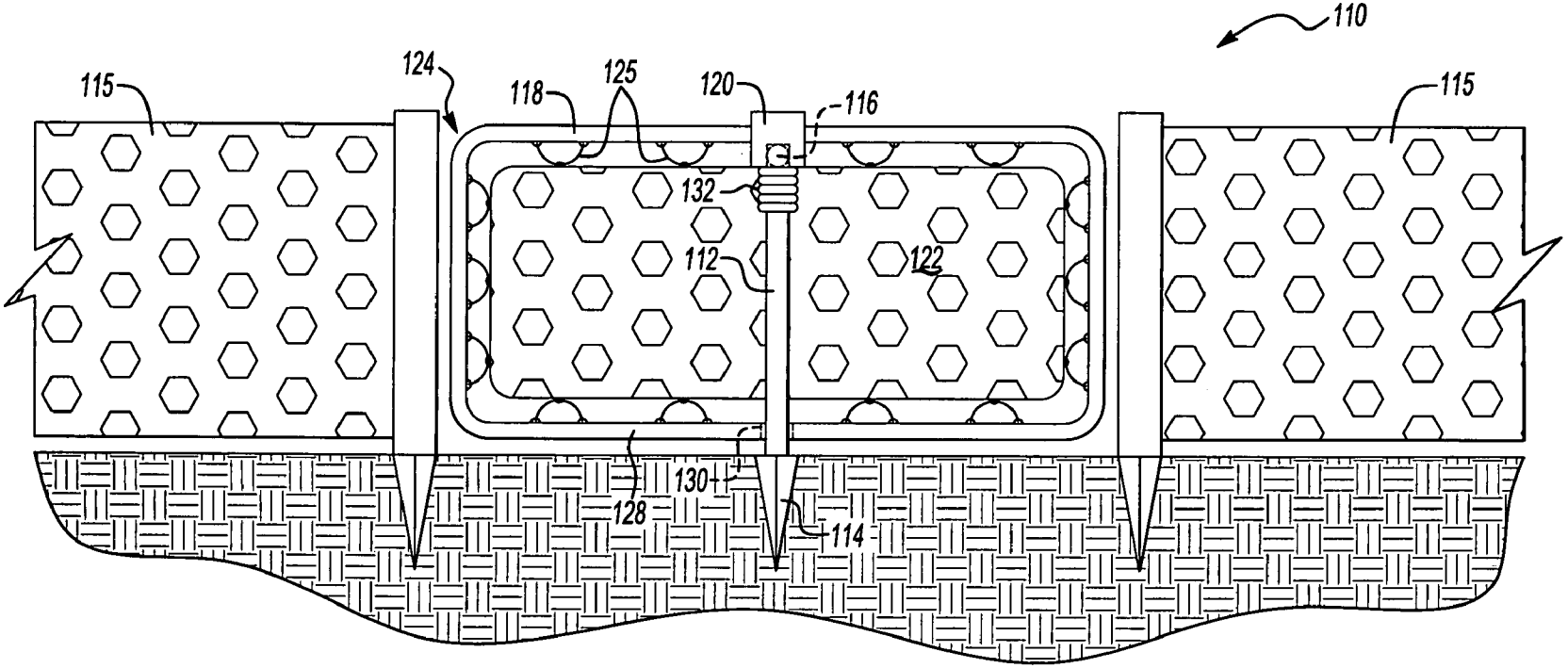
FIG. 16 is a plan view of a temporary gate assembly according to this invention.

Referring to FIG. 16, a temporary gate assembly 110 according to this invention is shown and includes a support 112 mounted within a post mount assembly 114. A ball bearing 116 is supported atop the support 112 to support rotation of a frame 118. The frame 118 includes a top cap 120 portion that fits over the ball bearing 116. The frame 118 provides an outer perimeter 124 for attachment of a flexible fencing material 122. The flexible material 122 is held to the frame 118 by a plurality of attachment devices 125, such as for example clips, springs, ties or other known devices. As is appreciated, a temporary fence indicated at 115 for many temporary fencing applications are utilized to temporarily limit access to a desired area such as during construction. In such instances it is desirable to positively define a boundary. However, as a conventional gate with unbalanced loads requires additional support, a gate is often simply not utilized, leaving an undesirable opening through the fence.

The temporary gate assembly 110 provides the frame 118 that is balanced about the support 112. The frame 118 provides a perimeter structure to which a flexible fencing material 122 is attached to complete the desired defined boundary. The frame 118 includes the top cap 120 that is supported for rotation on the ball bearing 116. A biasing member 132 is disposed between the frame 118 and the support 112 to bias the frame 118 to a desired position. The biasing member 132 is shown schematically and can be, for example, a coil spring, flexible rod or radial spring along with other known biasing members. The frame 118 also includes a bottom portion 128 having an opening 130 through which the support 112 extends. The support 112 is inserted within the ground, either within a post mount assembly 114 are simply driven into the ground as a stake. As the load of the gate 110 is centered vertically on the support 112, eliminating any coupling, additional support is not necessary for the temporary application. Accordingly, the temporary gate assembly 110 provides for use of gate in temporary applications where installation of a conventional unbalanced gate is not practical.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A vinyl gate assembly comprising:

a fixed support structure mounted along a vertical axis;

a center post defining an inner cavity and rotatable about said vertical axis relative to said fixed support;

a first vertical post and a second vertical post spaced apart horizontally from said center post;

a plurality of horizontal rails connecting said center post to said first vertical post and said second vertical post;

a bearing attached to said center post and rotatably supported on said fixed support;

a single ball bearing centered on said vertical axis and supported on said fixed support; and a support rod centered on said vertical axis and supported on said single ball bearing and attached to said center post.

2. The assembly as recited in claim 1, wherein said bearing comprises an inner opening for said fixed support and an outer periphery for attaching said center post.

3. The assembly as recited in claim 2, including an intermediate post attached to said outer periphery of said bearing and to said center post.

4. The assembly as recited in claim 3, wherein said intermediate post is circular and said center post is square.

5. The assembly as recited in claim 1, wherein said support rod is supported on said single ball bearing on a first end and is attached to said center post on a second end such that said center post rotates about said vertical axis.

6. The assembly as recited in claim 1, wherein said first vertical post, said second vertical post and said center post are fabricated from plastic.

7. The assembly as recited in claim 1, wherein said first vertical post, said second vertical post and said center post are fabricated from vinyl.

* * * * *

UNITED STATES PATENT AND TRADEMARK OFFICE

CERTIFICATE OF CORRECTION

PATENT NO. : 7,429,032 B2
APPLICATION NO. : 11/036667
DATED : September 30, 2008
INVENTOR(S) : Stull It is certified that error appears in the above-identified patent and that said Letters Patent is hereby corrected as shown below:

Claim 1, Column 6, line 66: Delete "vinyl"

Signed and Sealed this

Eighteenth Day of November, 2008

JON W. DUDAS
*Director of the United States Patent and Trademark Office*